US010166596B2

(12) United States Patent
Seeber

(10) Patent No.: US 10,166,596 B2
(45) Date of Patent: Jan. 1, 2019

(54) FORGING APPARATUS WITH FORGING RAMS GUIDED IN THE DIRECTION OF STROKE AND ACCOMMODATING FORGING TOOLS

(71) Applicant: GFM—GmbH, Steyr (AT)

(72) Inventor: Alfred Seeber, Steyr (AT)

(73) Assignee: GFM-GmbH, Steyr (AT)

( * ) Notice: Subject to any disclaimer, the term of this patent is extended or adjusted under 35 U.S.C. 154(b) by 692 days.

(21) Appl. No.: 14/872,330

(22) Filed: Oct. 1, 2015

(65) Prior Publication Data

US 2016/0096214 A1 Apr. 7, 2016

(30) Foreign Application Priority Data

Oct. 2, 2014 (AT) ..... 50704/2014

(51) Int. Cl.

| | |
|---|---|
| ***B21J 13/00*** | (2006.01) |
| ***B21J 7/20*** | (2006.01) |
| ***B21J 7/18*** | (2006.01) |
| ***B21J 7/14*** | (2006.01) |

(52) U.S. Cl.
CPC . *B21J 7/20* (2013.01); *B21J 7/14* (2013.01); *B21J 7/18* (2013.01)

(58) Field of Classification Search
CPC ..... B21J 7/14; B21J 7/18; B21J 7/20; H01R 43/04
USPC ..... 72/352
See application file for complete search history.

(56) References Cited

U.S. PATENT DOCUMENTS

| | | | | |
|---|---|---|---|---|
| 2,247,863 | A * | 7/1941 | Tiedemann | B21J 7/18 72/189 |
| 2,917,099 | A * | 12/1959 | Seward | H01R 43/04 72/400 |
| 5,609,056 | A | 3/1997 | Seeber | |
| 2016/0096214 | A1* | 4/2016 | Seeber | B21J 7/14 72/352 |

FOREIGN PATENT DOCUMENTS

| | | |
|---|---|---|
| DE | 25 07 301 A1 | 10/1975 |
| EP | 0 667 197 A1 | 8/1995 |

* cited by examiner

*Primary Examiner* — David B Jones
(74) *Attorney, Agent, or Firm* — Collard & Roe, P.C.

(57) ABSTRACT

The invention relates to a forging apparatus, comprising forging rams (4) that are guided in the direction of stroke and accommodate forging tools (3), and lifting drives (7) which can be driven by a shaft (10) and which are supported in a non-positive manner on an abutment (12) of the forging rams (4) held under pretension in contact on the lifting drives (7). In order to provide simple constructional conditions it is proposed that the shafts (10) of the lifting drives (7) comprise two drive cams (11) which are angularly offset by 180° in relation to each other, are centrally symmetric with respect to the shaft axis, and cooperate with the abutments (12) of the forging rams (4).

3 Claims, 6 Drawing Sheets

FORGING APPARATUS WITH FORGING RAMS GUIDED IN THE DIRECTION OF STROKE AND ACCOMMODATING FORGING TOOLS

CROSS REFERENCE TO RELATED APPLICATIONS

Applicant claims priority under 35 U.S.C. § 119 of Austrian Application No. A50704/2014 filed on Oct. 2, 2014, the disclosure of which is incorporated by reference.

FIELD OF THE INVENTION

The invention relates to a forging apparatus, comprising forging rams that are guided in the direction of stroke and accommodate forging tools, and lifting drives which can be driven by a shaft and which are supported in a non-positive manner on an abutment of the forging rams held under pretension in contact on the lifting drives.

DESCRIPTION OF THE PRIOR ART

In order to utilise the advantages of eccentric drives for the drive of the forging rams of forging apparatuses without having to use a connecting rod for the transmission of forces between the eccentric and the forging ram accommodating a forging tool, it is known (EP 0 667 197 A1) to mount a sliding block on the eccentric, which sliding block rests in a non-positive manner on an abutment of the forging ram formed in the shape of a sliding plate, so that high pressure forces can be transmitted to the forging ram via the sliding block. As a result of the non-positive support of the sliding block on the abutment of the forging ram, the return of the forging ram during the return stroke of the lifting drive cannot be performed by the sliding block, so that the forging ram needs to be retained in contact on the sliding block by means of pressurisation by a spring. Irrespective of whether the forging ram is pressurised by a connecting rod or a sliding block, eccentric drives come with the disadvantage that it is necessary to ensure mass balancing. Furthermore, a full rotation of the eccentric shaft is necessary for a forging stroke and the subsequent return stroke, without being able to influence the speed of stroke along the stroke path.

SUMMARY OF THE INVENTION

The invention is thus based on the object of forming a forging apparatus with radially guided forging rams in such a way that the advantages of eccentric drives can be ensured without having to accept their disadvantages especially concerning the required mass balancing and the limitation of the stroke rate on the speed of the eccentric shaft.

On the basis of a forging apparatus of the type as described above, the invention solves this object in that the shafts of the lifting drives comprise two drive cams which are angularly offset by 180° in relation to each other, are centrally symmetric with respect to the shaft axis, and cooperate with the abutments of the forging ram.

As a result of the two drive cams of the drive shaft, which are situated diametrically opposite each other and are used once each during a rotation of the shaft, a double stroke frequency is achieved in comparison with a conventional eccentric drive, wherein high pressure forces can be transmitted onto the abutment of the forging Rams via the drive cams in a manner similar to a sliding block. The centric symmetry of the two drive cams with respect to the axis of the drive shaft renders the need for additional mass balancing superfluous, which leads to a lifting drive for the forging rams which substantially utilises the advantages of eccentric drives without having their disadvantages. Furthermore, the stroke velocity of the forging rams along the stroke path can be influenced both during the forging stroke and also the return stroke via the shape of the drive cams and thus an adjustment to different forging conditions can be achieved.

Especially simple constructional conditions are obtained when the shaft has an oval cross-section in the region of the drive cams. It needs to be considered in this connection that the forging stroke is only slightly greater than the maximum reduction of the workpiece radius to be carried out in a forging process, so that the difference between the largest and the smallest oval diameter remains comparatively small.

Lifting drives with two drive cams which are mutually diametrically opposite on the drive shaft further represent advantageous constructional conditions for good load transfer to the frame forging apparatus accommodating the forging rams when the shaft of the lifting drives is rotatably guided between two bearing shells, which are arranged between two support bearings which are fixed to the frame and are opposite in the abutment of the forging rams on the one hand and in this abutment on the other hand, because in this case the ram forces can be transferred by the drive shaft directly onto the support bearing fixed to the frame without subjecting the drive shaft to bending loads, as is inevitably the case in drive shafts mounted laterally adjacent to the drive cams. The displacement of the rotational axis, which is caused by the direct support of the drive shaft on the support bearing fixed to the frame, needs to be considered however by a compensating coupling in the course of the drive connection. If the support bearing is displaceably mounted in the frame perpendicularly to the shaft and perpendicularly to the lifting direction, advantageous constructional conditions are obtained with respect to the loading of the bearing shells, which is especially advantageous concerning the wearing behaviour.

In order to simply set the stroke position of the rams, the support bearing on the frame side for the drive cams can be adjustably arranged in the lifting direction. The adjustment of the support bearing in the lifting direction displaces the lifting drive and thus the stroke position of the rams.

BRIEF DESCRIPTION OF THE DRAWING

The subject matter of the invention is shown in the drawings by way of example, wherein.

DESCRIPTION OF THE PREFERRED EMBODIMENT

Figure 1:
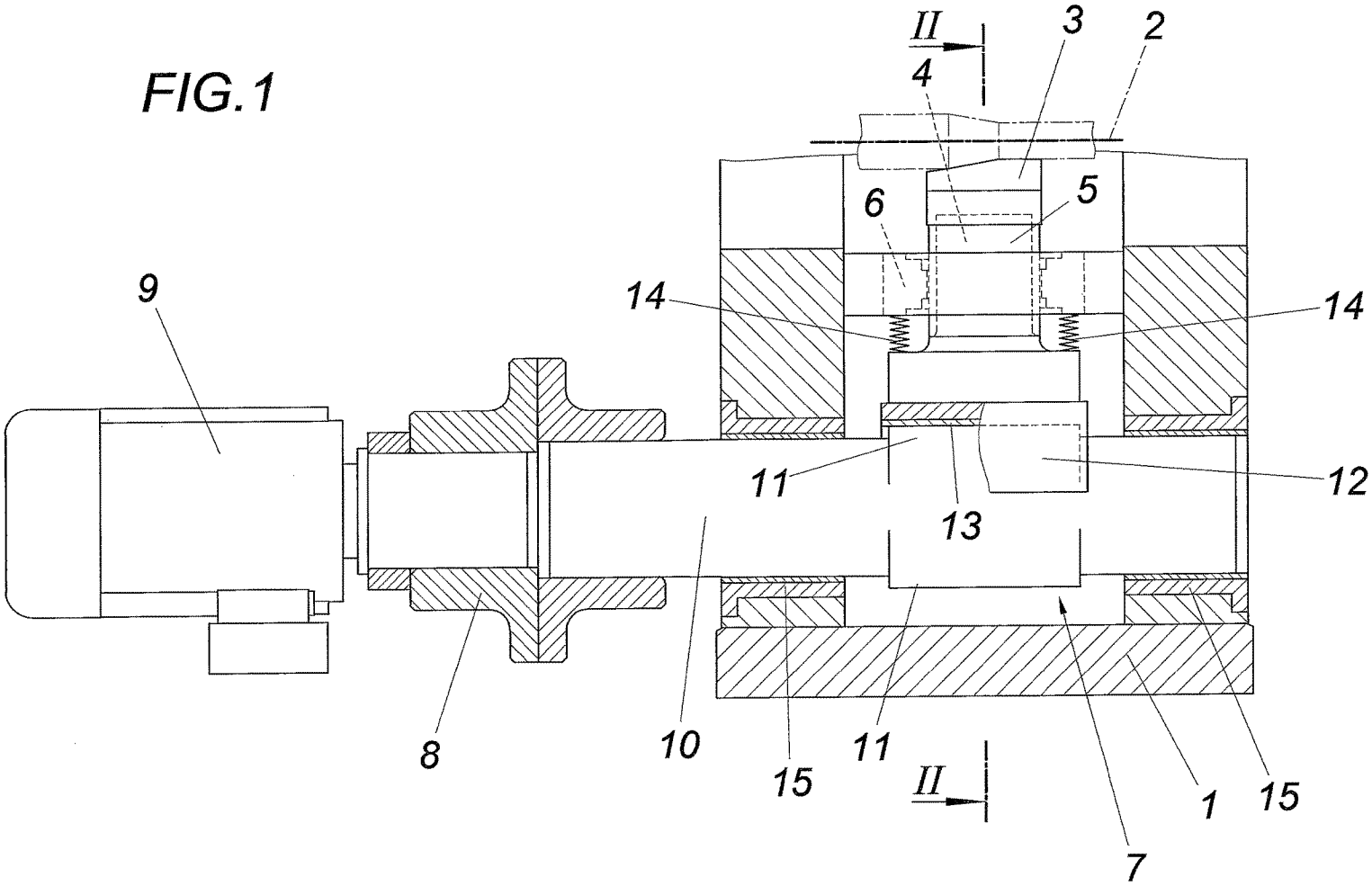
FIG. 1 shows a schematic longitudinal sectional view in sections of a forging apparatus in accordance with the invention in the region of a lifting drive for the forging ram of a forging tool.
Figure 2:
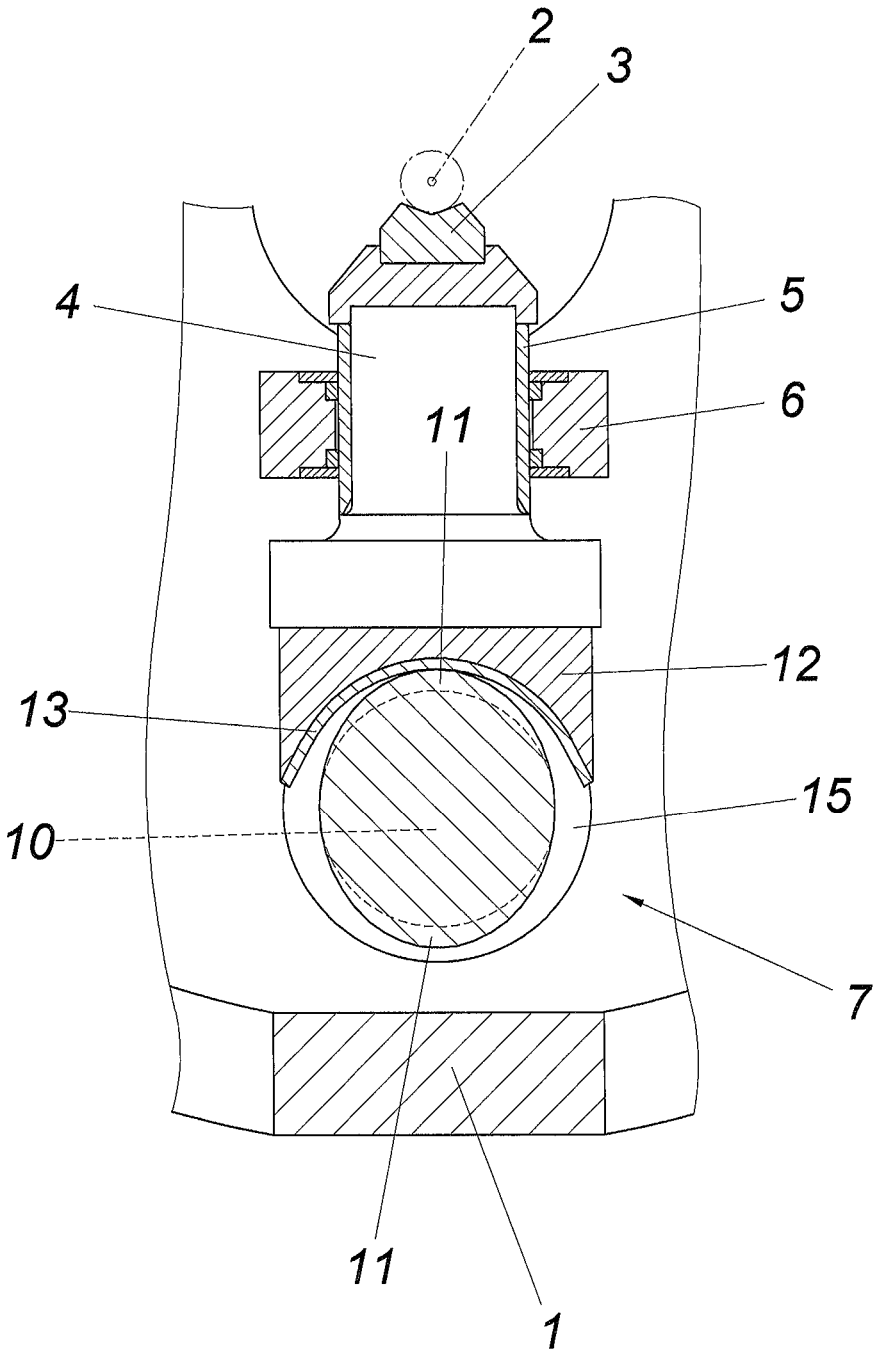
FIG. 2 shows said forging apparatus in a sectional view along the line II-II of FIG. 1 on an enlarged scale.

The forging apparatus according to FIGS. 1 and 2 comprise a frame 1, e.g. having four forging tools 3 which are distributed around a forging axis 2 and which are exchangeably arranged on rams 4. The rams 4, of which only one is shown, are displaceably mounted in the frame 1 radially to the forging axis 3. For this purpose, the frame 1 forms a guide bearing 6 for each ram 4 provided with a sliding sleeve 5.

The rams 4 are connected to lifting drives 7, which comprise a shaft 10 which is connected via a coupling 8 to a drive motor and which comprise two drive cams 11 which are angularly offset against each other by 180° and are centrally symmetric with respect to the shaft axis. For the purpose of forming these drive cams 11, the shafts 10 are provided in the cam region with an oval cross-section, as is shown especially in FIG. 2. The drive cams 11 cooperate with abutment 12 of the rams 4, which is provided with a cylindrical bearing shell 13 via which the rams 4 can be held to be pressed against the shaft 10 in the known manner by means of pressure springs 14 which are only schematically indicated in FIG. 1 and can be of different configuration, because it is only necessary to return the rams 4 with the forging tools 3 in the return stroke according to the progression of the drive cams 11.

The shaft 4 for the lifting drive 7 is rotatably mounted in radial bearings 15 on both sides of the drive cams 11, via which the loads caused by the forging forces need to be transferred from the shaft 4 to the frame 1. If the shaft 4 is driven by the drive motor 9, both drive cams 11 are used during a rotation of the shaft with the effect that not only the stroke frequency of the rams 4 is doubled in comparison with conventional eccentric drives, but that also substantial mass balancing can be achieved if a conventional rotational-symmetric arrangement of the forging tools is assumed. In conjunction with abutments 12 having cylindrical sliding blocks 13, advantageous lubricating conditions between the sliding shells 13 and the drive cams 11 can also be maintained, thus providing generally advantageous constructional conditions.

Figure 3:
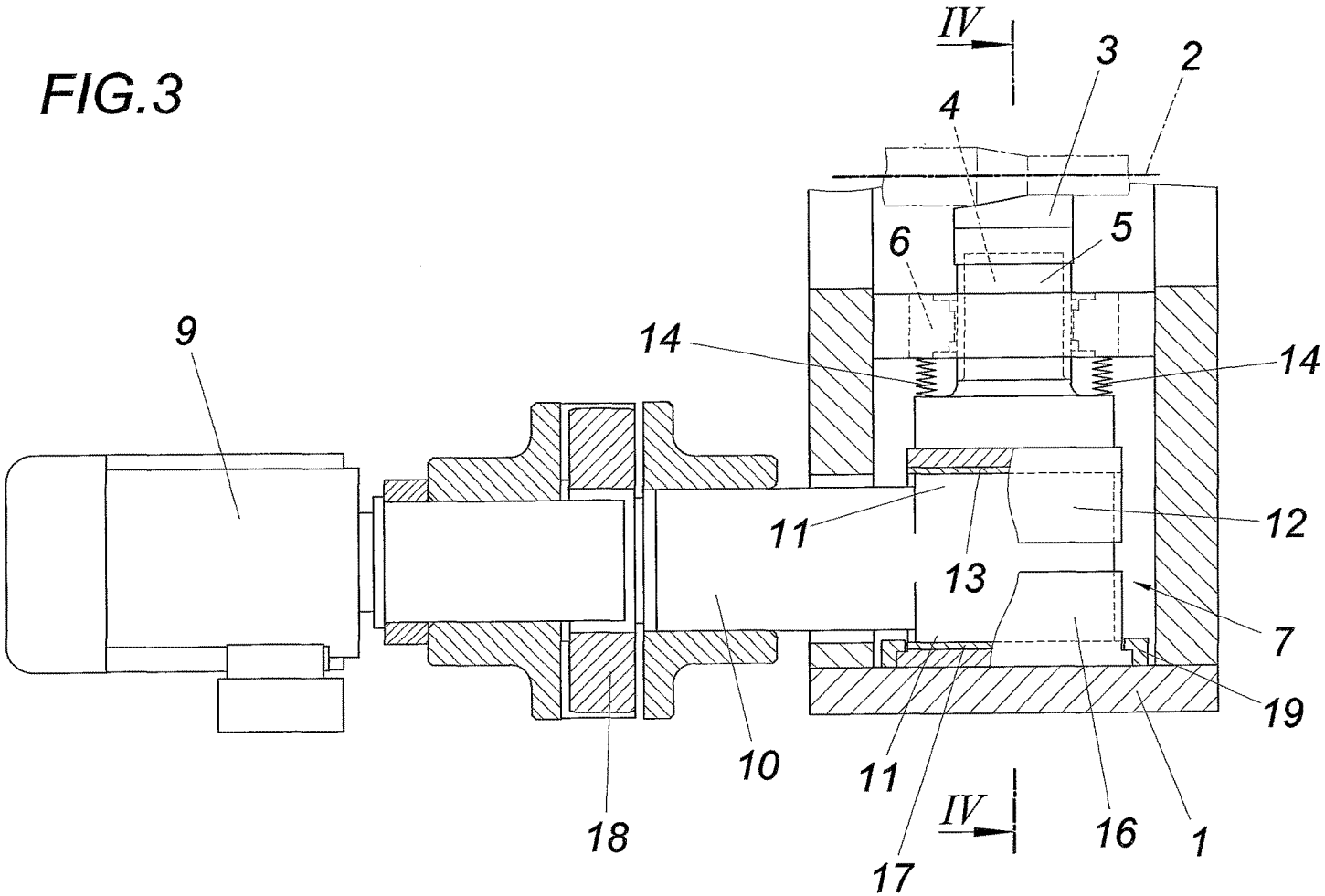
FIG. 3 shows a view corresponding to FIG. 1 of a constructional variant of a forging apparatus in accordance with the invention.
Figure 4:
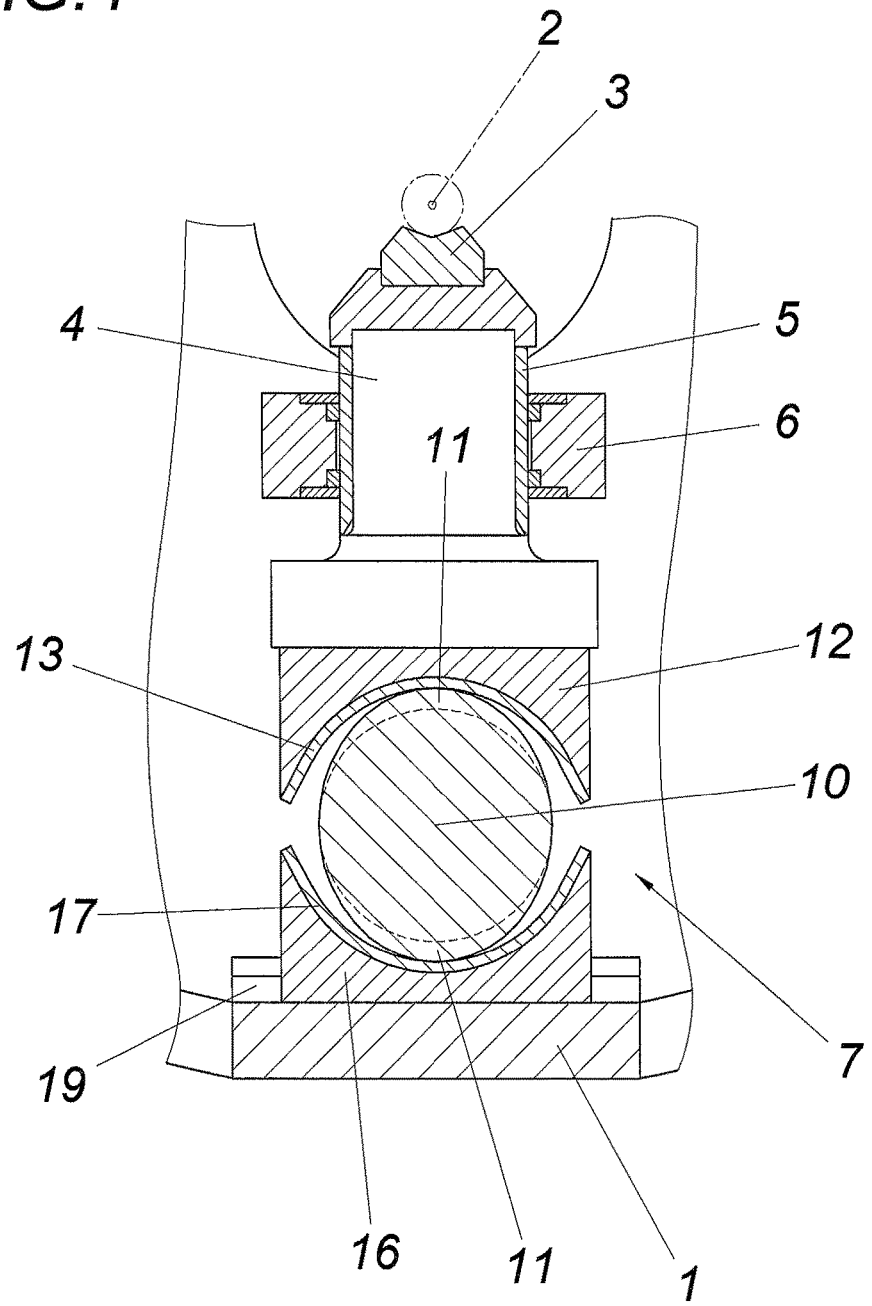
FIG. 4 shows a sectional view along the line IV-IV of FIG. 3 on an enlarged scale.

The constructional preconditions can additionally be improved even further according to the embodiment according to FIGS. 3 and 4 when the shaft 10 of the lifting drives 7 is not mounted in radial bearings 15 laterally to the drive cams 11, but is rotatably guided between two cylindrical bearing shells 13, 17 formed by the abutment 12 of the rams 4 on the one hand and by a support bearing 16 on the other hand, which support bearing is opposite said abutment 12 and is supported in the direction of stroke on the frame 1. In this case, the loads caused by the forging forces are transferred via the drive cams 11 and the support bearing 16 directly to the frame 1, so that the shaft 4 of the lifting drive 7 is not subjected to any bending loads. However, the inevitably occurring displacement of the shaft axis needs to be considered, which can be solved in a simple way by providing a compensating coupling 18 between the drive motor 9 and the shaft 10. The bearing of the shaft 4 of the lifting drives 7 between two cylindrical bearing shells 13, 17 via the drive cams 11 leads to the additional advantage that for a predetermined stroke the radial excess length of the drive cams 11 in relation to the circular shaft cross-section merely needs to correspond to a half the stroke, so that the drive cams 11 lead to only comparatively low deviations from the circular cross-section, which has an advantageous effect on the bearing conditions of the shaft 10 between the two bearing shells 13, 17. It is still recommended however to displaceably mount the support bearing 16 in relation to the frame 1 perpendicularly to the shaft 10 and perpendicularly to the direction of stroke in order to prevent additional loads that occur otherwise. This displaceable bearing of the support bearings by guides 19 for the support bearings 16 is indicated in FIGS. 3 and 4.

Figure 5:
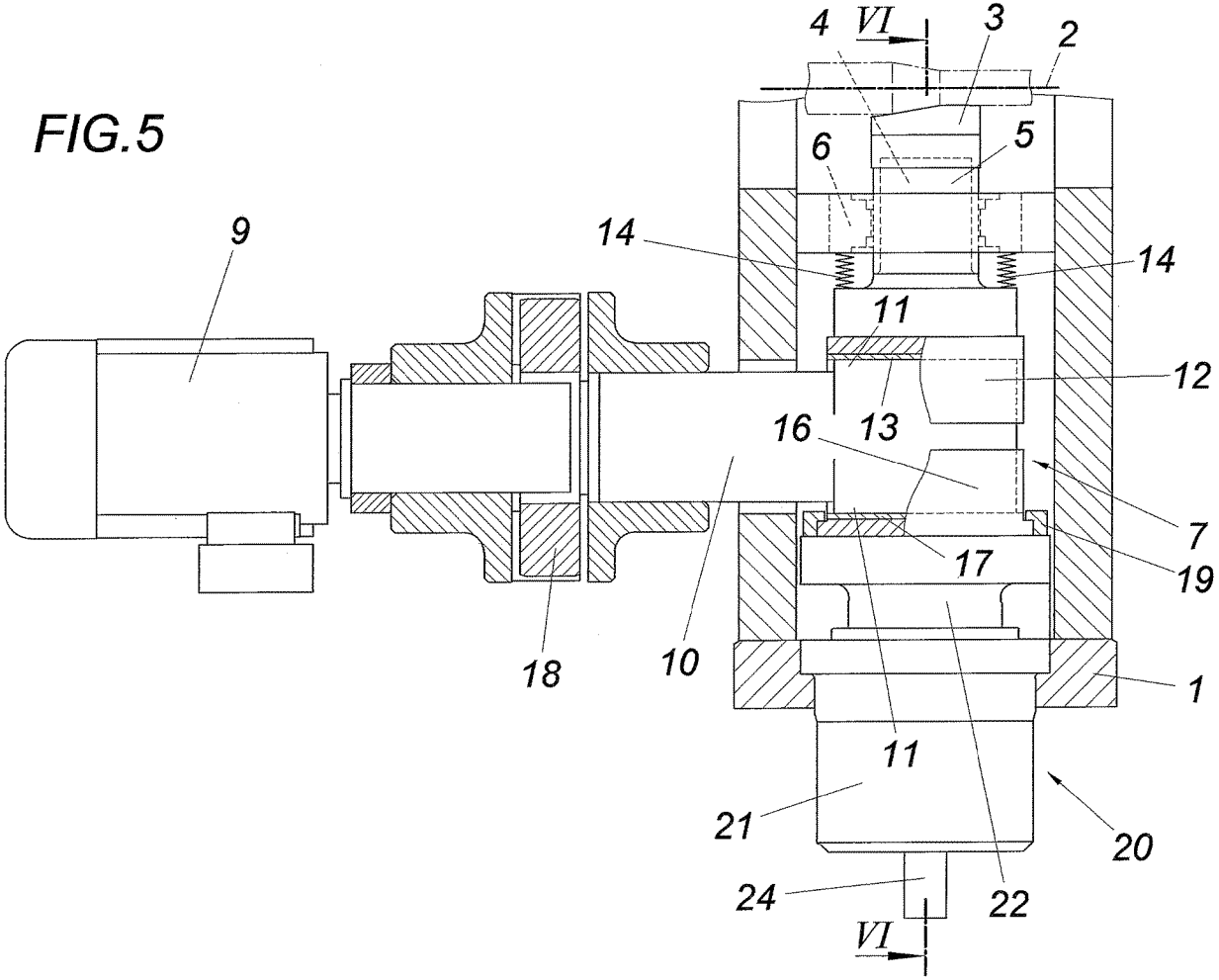
FIG. 5 shows a further embodiment of a forging apparatus in accordance with the invention in a view corresponding to FIG. 1.
Figure 6:
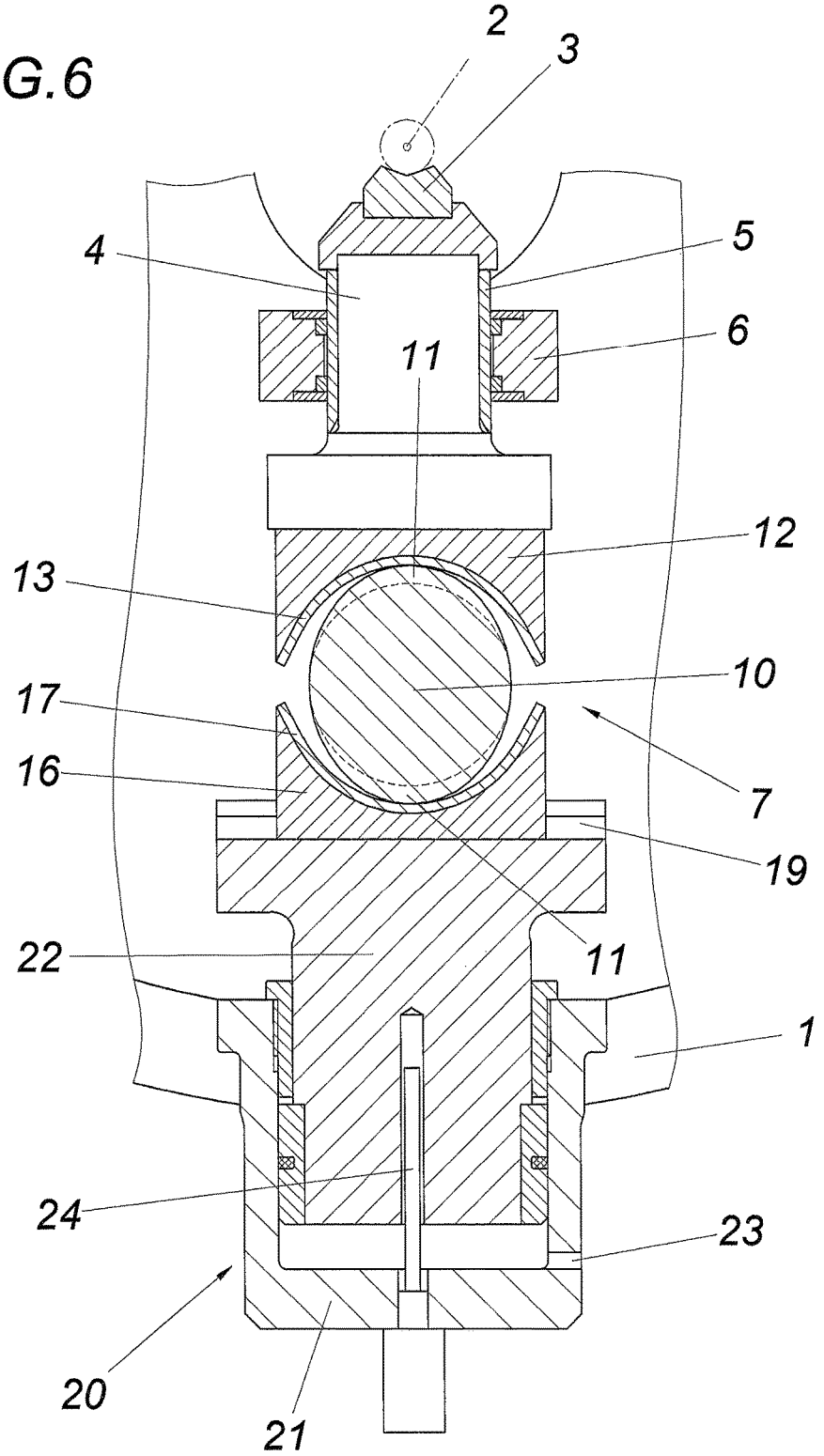
FIG. 6 shows a sectional view along the line VI-VI of FIG. 5 on an enlarged scale.

The embodiment according to FIGS. 5 and 6 substantially corresponds to the embodiment according to FIGS. 3 and 4. In contrast to FIGS. 3 and 4, the stroke position can additionally be set. For this purpose, the support bearing 16 associated with the frame 1 can be adjusted in the direction of stroke, i.e. radially to the forging axis 2. For this purpose, an actuating drive 20 is provided, which is formed in accordance with the embodiment as a hydraulic actuating drive, which is in not mandatory in any way. The piston 22, which is mounted in the cylinder 21 of the actuating drive 20 which is fixed to the frame, is actuated via a hydraulic medium connection 23, wherein the actuating part is monitored via a measuring device 24. Since the support bearing 16 is carried by the piston 22 of the actuating drive 20, the stroke position of the rams 4 is also changed by an adjustment of the piston 22. The stroke per se remains unchanged, which merely depends on the formation of the drive cams 11. The additional actuating possibility for the support bearing 16 must be considered in addition, e.g. via the compensating coupling 18 for example.

The invention claimed is:

1. A forging apparatus, comprising:

(a) first and second forging rams guided in a stroke direction and comprising a first abutment and a second abutment, respectively;

(b) first and second forging tools accommodated in the first and second forging rams, respectively;

(c) first and second shafts having a first shaft axis and a second shaft axis, respectively;

(d) first and second lifting drives driven by the first and second shafts, respectively, and supported on the first and second abutments, respectively, the first and second abutments being held in contact on the first and second lifting drives, respectively;

(e) a frame; and (f) first and second support bearings disposed on the frame;

wherein the first shaft comprises first and second drive cams angularly offset by 180° in relation to each other, centrally symmetric with respect to the first shaft axis, and cooperating with the first abutment;

wherein the second shaft comprises third and fourth drive cams angularly offset by 180° in relation to each other, centrally symmetric with respect to the second shaft axis, and cooperating with the second abutment;

wherein the first shaft is rotatably guided between first and second bearing shells, wherein the first bearing shell is arranged in the first abutment and the second bearing shell is arranged opposite of the first bearing shell in the first support bearing supported in the stroke direction on the frame;

wherein the second shaft is rotatably guided between third and fourth bearing shells, and the third bearing shell is arranged in the second abutment and the fourth bearing shell is arranged opposite of the third bearing shell in the second support bearing supported in the stroke direction; and wherein the first support bearing is mounted perpendicularly to the first shaft and is displaceably mounted in the frame perpendicularly to the stroke direction and the second support bearing is mounted perpendicularly to the second shaft and is displaceably mounted in the frame perpendicularly to the stroke direction.

2. The forging apparatus according to claim 1, wherein the first shaft has an oval cross-section in a region of the first and second drive cams and the second shaft has an oval cross-section in a region of the third and fourth drive cams.

3. A forging apparatus, comprising:

(a) first and second forging rams guided in a stroke direction and comprising a first abutment and a second abutment, respectively;

(b) first and second forging tools accommodated in the first and second forging rams, respectively;

(c) first and second shafts having a first shaft axis and a second shaft axis, respectively;

(d) first and second lifting drives driven by the first and second shafts, respectively, and supported on the first and second abutments, respectively, the first and second abutments being held in contact on the first and second lifting drives, respectively;

(e) a frame; and (f) first and second support bearings disposed on the frame;

wherein the first shaft comprises first and second drive cams angularly offset by 180° in relation to each other, centrally symmetric with respect to the first shaft axis, and cooperating with the first abutment;

wherein the second shaft comprises third and fourth drive cams angularly offset by 180° in relation to each other, centrally symmetric with respect to the second shaft axis, and cooperating with the second abutment;

wherein the first shaft is rotatably guided between first and second bearing shells, and the first bearing shell is arranged in the first abutment and the second bearing shell is arranged opposite of the first bearing shell in the first support bearing supported in the stroke direction on the frame;

wherein the second shaft is rotatably guided between third and fourth bearing shells, and the third bearing shell is arranged in the second abutment and the fourth bearing shell is arranged opposite of the third bearing shell in the second support bearing supported in the stroke direction; and wherein the first and second support bearings are adjustably mountable on the frame in the stroke direction.

* * * * *